United States Patent [19]

Okamoto

[11] Patent Number: 4,860,063

[45] Date of Patent: Aug. 22, 1989

[54] METHOD OF CONTROLLING DEVELOPER TONER DENSITY OF DEVELOPING DEVICE

[75] Inventor: Yukio Okamoto, Hachioji, Japan

[73] Assignee: Konica Corporation, Tokyo, Japan

[21] Appl. No.: 132,408

[22] Filed: Dec. 14, 1987

[30] Foreign Application Priority Data

Dec. 12, 1986 [JP] Japan ..... 61-294707

[51] Int. Cl.[4] ..... G03G 15/08

[52] U.S. Cl. ..... 355/208; 118/689; 430/30; 355/246

[58] Field of Search ..... 355/300, 140; 430/30, 430/31, 122; 118/688, 687, 690

[56] References Cited

U.S. PATENT DOCUMENTS 4,208,985 6/1980 Anzai et al. ..... 118/689 X
4,277,549 7/1981 Tatsumi et al. ..... 355/14 D X
4,611,905 9/1986 De Schamphelaere ..... 355/14 D

FOREIGN PATENT DOCUMENTS 59-44076 3/1984 Japan ..... 355/14 D
60-229073 11/1985 Japan ..... 355/14 D

*Primary Examiner*—Arthur T. Grimley
*Assistant Examiner*—J. Pendegrass
*Attorney, Agent, or Firm*—Jordan B. Bierman

[57] ABSTRACT

A control method of supplying toner to a developing device wherein a toner supply to the developing device is controlled so that a level of the toner density is increased in a range not more than a predetermined level at a predetermined interval of an integrated development period while the developing device continues its developing operations without any continuous interruption longer than a constant period, and the level of the toner density is decreased when the continuous interruption is longer than said constant period.

8 Claims, 3 Drawing Sheets

METHOD OF CONTROLLING DEVELOPER TONER DENSITY OF DEVELOPING DEVICE

BACKGROUND OF THE INVENTION

1. Field of the Invention

The present invention relates to a method of controlling the developer toner density of a developing device such as an electrophotographic reproducing machine.

2. Description of the Prior Art

As the method of controlling the developer toner density of a developing device using a two-component developer container toner and magnetic carrier, there has been known in the prior art a method of supplying the toner to the developing device in a manner to hold at a constant level the output of a toner sensor for detecting the toner density (magnetic permeability) variations in terms of the magnetoresistance variations of the developer. In case continuous copying operation are performed by the electrophotographic reproducing machine using such a developing device, the developer toner density gradually drops up to 100 copies, as indicated by a broken curve in FIG. 4, despite of the fact the toner sensor output is held at a constant level. This invites a phenomenon that the copy density accordingly drops.

According to an inventor's investigations, the main cause for that phenomenon is as follows. If the development is continued in the continuous copying operations by the developing device, the charges of the toner will gradually accumulate until they become saturated after an agitation period of 5 to 10 minutes or in a copy number of 100 sheets, because the developer in the developing device is agitated during the continuous copying operations by the agitation roller. The more the charges increase, the more the electric repulsions between the toner particles will increase to enlarge the gaps between the carrier particles. As a result, the magnetic resistance of the developer increases so that the output of the toner sensor varies similarly to the case in which the toner density increases. In order to prevent the reduction of the toner density for that cause, it has also been investigated to be effective that a level at which the output of the toner sensor has to be held constant is gradually varied in the direction to increase the toner density until the charges of the toner become saturated. Since the toner charges will not abruptly attenuate even if the development or agitation is interrupted, they may be made to become saturated in terms of the integrated development period or copy number, assuming that an identical charged state is held within the interruption of a constant period. It is therefore sufficient that the varied ouput level of the toner sensor to be held may be returned back in case the interruption period exceeds a constant value.

SUMMARY OF THE INVENTION

As object of the present invention is to provide a method of controlling the developer toner density using a toner sensor so as to always hold the toner density of the developer at a constant level, thereby to achieve a constant recording image density.

According to the present invention, there is provided a control method of supplying toner to a developing device. This method comprises the steps of: detecting a magnetoresistance level of the developer; comparing the magnetoresistance level with a reference level; feeding the toner to be supplied to the developing device in accordance with the comparison between the magnetoresistance level and the reference level; and decreasing the reference level in accordance with an interruption time for developing. This interruption time is longer than a predetermined time having no substantial attenuation of the magnetoresistance of the developer.

The operation time of the developing device means such a time that the developing device performs the developing and more preferably performs the agitation of the developer.

The other objects and characteristics of the present invention is hereinafter described according to illustrations.

DESCRIPTION OF THE PREFERRED EMBODIMENT

Figure 1:
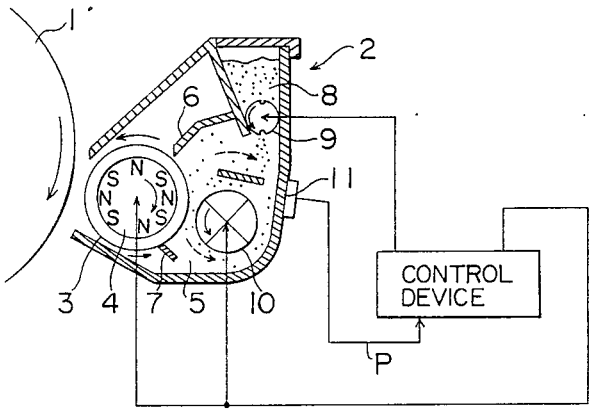
FIG. 1 is a diagram showing the structure of a portion of a recording apparatus for accomplishing the method of the present invention.

In FIG. 1, reference numeral 1 denotes a photosensitive drum which is made rotatable in a direction of arrow, and numeral 2 denotes a developing device. In the photosensitive drum 1, an electrostatic image having been formed by known electrostatic image forming means disposed upstream of the developing device 2 is developed into a toner image by the developing device 2. The toner image thus developed is transferred to recording paper by known transfer means disposed downstream of the developing device 2, and the recording paper has its transferred toner image fixed by known fixing means until it is discharged to the outside of the recording device.

In the developing device 2, by a magnetic force of a magnet 4 disposed in a sleeve 3 made of a non-magnetic material such as aluminum or stainless steel, a developer in a developer reservoir 5, which is a mixture of toner and a magnetic carrier, is attracted to the surface of a sleeve 3. By an arrowed rotations of the magnet 4 and/or the sleeve 3, the attracted developer is conveyed in the direction of arrow. In this midway of conveyance, the developer has its thickness regulated by a layer thickness regulating blade 6 to form a developer layer. This developer layer develops the electrostatic image of the photosensitive drum 1 into the toner image at a developing region in which the sleeve 3 is positioned close to the photosensitive drum 1. Moreover, the developer layer having passed through the developing region is removed from the sleeve 3 and returned to the developer reservoir 5 by a cleaning blade 7. The developer reservoir 5 is supplied with the toner in an amount corresponding to the consumption of development from a toner hopper 8 by the rotations of a toner supply roller 9. Thus, the developer in the developer reservoir 5 is agitated to effect a uniform mixture of the toner and the carrier and to have its toner frictionally charged by the rotations of an agitation roller 10.

A control device rotates the sleeve 3, magnet 4 and agitation roller 10 of the developing device 2 while a set recording number of electrostatic images are being developed. In response to a toner density information p outputted in this meanwhile from a toner sensor 11, the control device further rotates the toner supply roller 9 if the information p becomes higher than $(L+\Delta L)$ in the example of FIG. 2 and lower than $(L-\Delta L)$ in the example of FIG. 3. The rotations of the toner supply roller 9 are stopped to hold the information p at a constant level L if the information p becomes lower than $(L-\Delta L)$ in an example of FIG. 3 and higher than $(L+\Delta L)$ in an example of FIG. 2. If the constant level L is neither at $L_{min}$ in the example of FIG. 2 nor at $L_{max}$ in the example of FIG. 3, the control device decreases and increases the constant level L by $(L_{max}-L_{min})/n$ at a predetermined time interval T by a timing t from either the rotation start of the agitating roller 10 and so on or the renewal of the level L in the examples of FIGS. 2 and 3, respectively, until the level L reaches the values $L_{min}$ and $L_{max}$ in the examples of FIGS. 2 and 3, respectively. This renewal may be accomplished at each set recording number by counting the recording number. If the rotations of the agitation roller 10 and so on are stopped when the developments of the set recording number is finished, moreover, the control device makes renewals to increase and decrease the constant level L by $(L_{max}-L_{min})/n$ at a predetermined time interval T' by a timing t' of the stop period from the stop in the examples of the FIGS. 2 and 3, respectively, until the level L reaches the values $L_{max}$ and $L_{min}$ in the examples of FIGS. 2 and 3, respectively.

Figure 2:
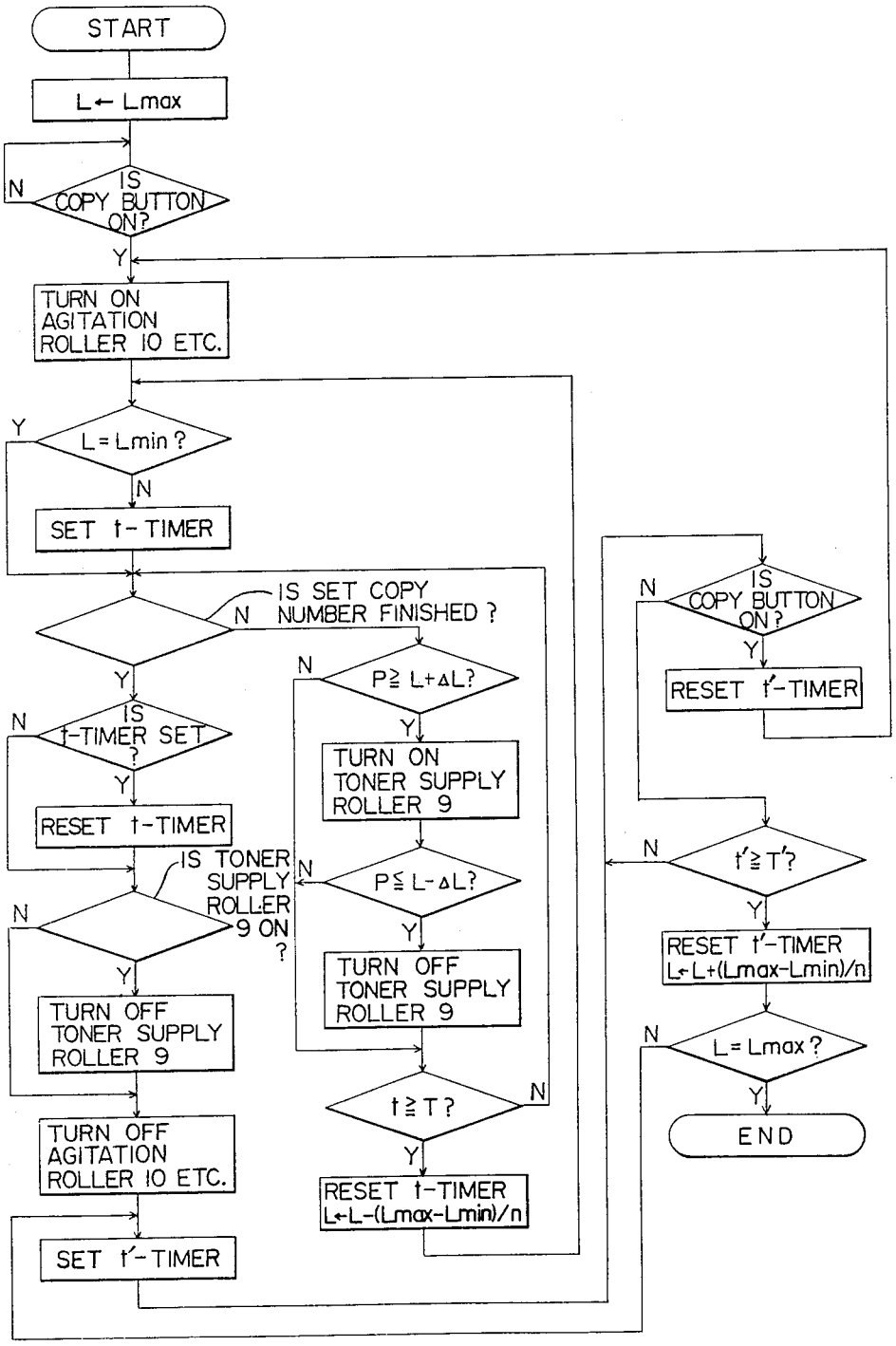
FIGS. 2 and 3 are flow charts showing examples of a control device in case toner sensors having the higher and lower outputs for higher toner density are used, respectively.
Figure 3:
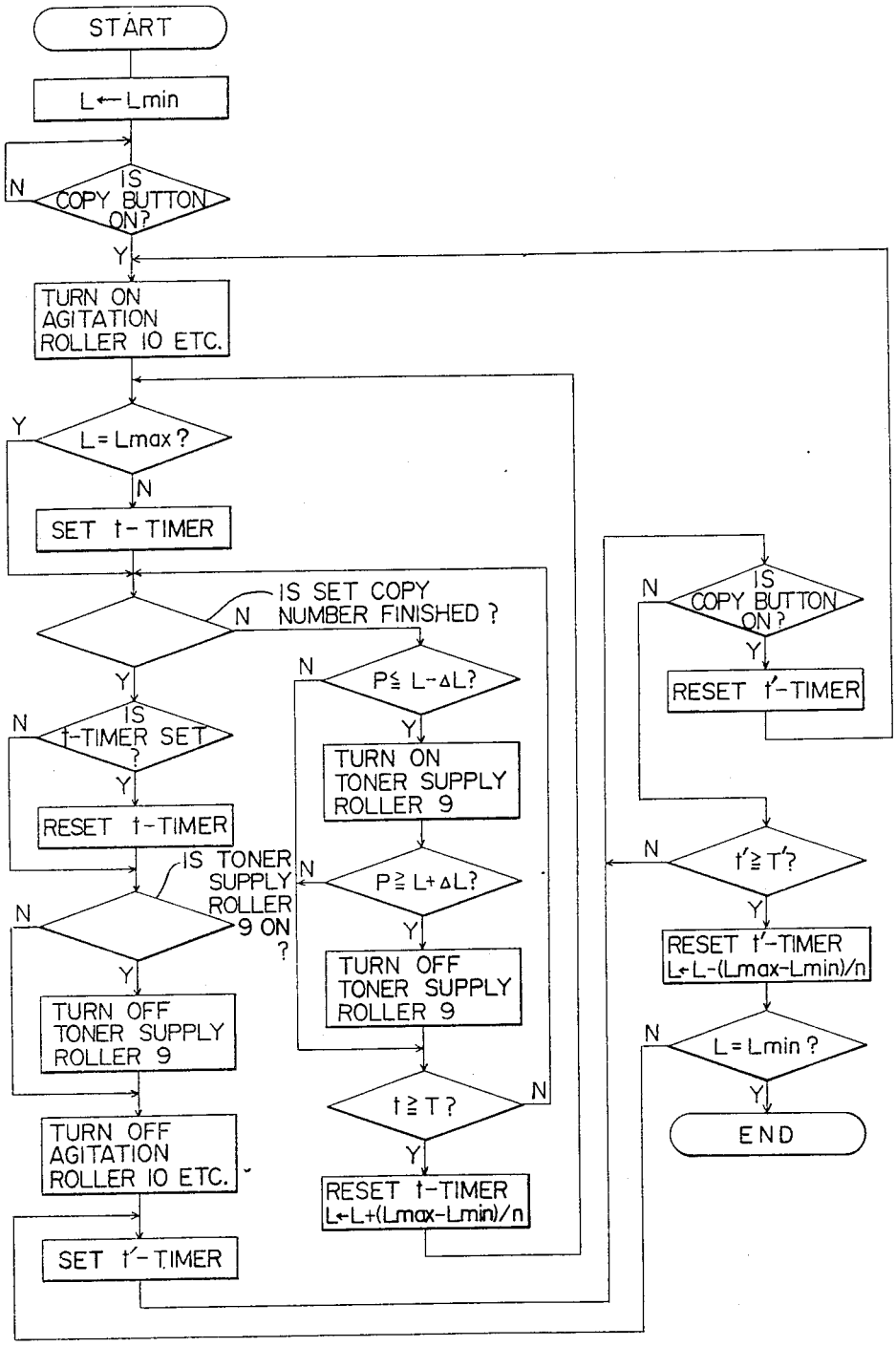

FIG. 2 shows a flow chart of control wherein an developer having such a characteristic that the output of the sensor increases according to the decrease of the toner density is used. FIG. 3 shows a flow chart of control wherein a developer having such a characteristic that the output of the sensor decreased according to the decrease of the toner density is used.

Figure 4:
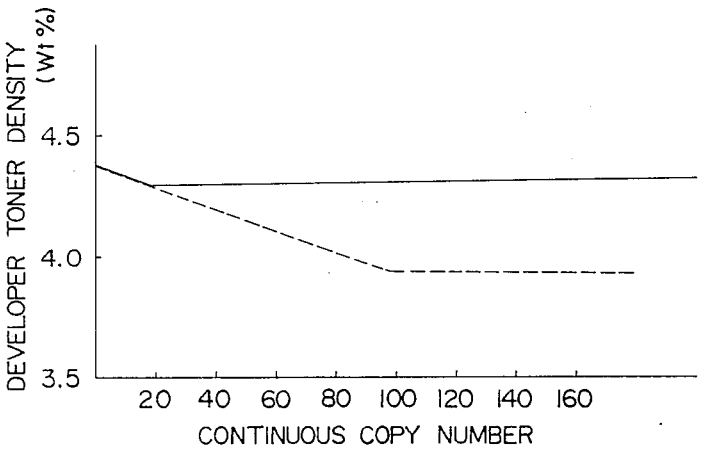
FIG. 4 is a graph showing the toner density obtained by the controls of FIGS. 2 and 3.

By the controls of toner supply thus performed by the control device, the developer toner density of the developing device 2 is held at the constant level, as indicated by a solid curve in FIG. 4, so that recording image density is held at a constant level.

A specific example of the present invention will be described in the following:

EXAMPLE

The following assumptions were made: The output p of the toner sensor 11 of FIG. 1 as 2.5 V for the toner density of 4% of the developer in the state in which the developing device 2 was driven after a long term of stop; and the output p dropped to 1.5 V for the sensitivity of 1 V/%, i.e., the toner density of 5%. It was also assumed that, if the developing device 2 was driven, the control device made a control at first to turn on and off the toner supply roller 9 for $p>2.5$ V and $p<2.4$ V, respectively, and that the control device had its control level dropping by 0.1 V for every twenty copies and kept a control to turn on and off the same for $p>2.0$ V and $p<1.9$ V, respectively, after five drops, i.e., one hundred copies. Moreover, if the ON and OFF control levels of the toner supply roller 9 were varied from 2.5 V and 2.4 V when the drive of the developing device 2 was stopped, the time period to a next drive of the developing device 2 was timed to repeat the increase of 0.1 V of the control level for every twelve minutes until the ON and OFF control levels reached 2.5 V and 2.4 V. Assuming $L_{max}=2.45$ V, $\Delta L=0.05$ V, $L_{min}=1.95$ V, $n=5$, and $T'=12$ minutes in FIG. 2, more specifically, the control device made the controls under the conditions that a copy number counter was used in place of a t-timer, that the letter t denoted the count number of the counter, and that $T=20$.

In case that the copy is not continued perfectly, but is initiated within a predetermined time (in this case, twelve minutes) from the stop of copying, the control is carried out as to the continuous copy.

By the toner supply control thus far described, the developer toner density of the developing device 2 could be held at a constant level so that copies of stable density could be obtained at all times.

According to the present invention, there can be attained an excellent effect that the control of toner supply can be accomplished on the basis of the output information of the toner sensor so that the developer toner density of the developing device may be constant at all times.

What is claimed is:

1. A method for controlling a toner density of a developer in a developing device, which comprises:

detecting a magnetoresistance level of said developer; comparing said magnetoresistance level with a reference level; feeding a toner to be supplied to said developing device in accordance with said comparison between said magnetoresistance level and said reference level; and decreasing said reference level in accordance with an interruption time for developing wherein said interruption time is longer than a predetermined time wherein there is no substantial attenuation of said magnetoresistance of said developer.

2. The method of claim 1 wherein said reference level is increased during a developing operation time during which no said interruption time occurs.

3. The method of claim 1 wherein said reference level is decreased stepwise.

4. The method of claim 2 wherein said reference level is increased stepwise.

5. The method of claim 1 wherein said reference level is varied between a first and second predetermined level.

6. A method for controling a toner density of a developer in a developing device, which comprises: detecting a magnetoresistance level of said developer; comparing said magnetoresistance level with a reference level; feeding a toner to be supplied to said developing device in accordance with said comparison between said magnetoresistance level and said reference level; increasing said reference level to a first predetermined level during a developing operation time wherein said developing operation time does not have an interruption time for developing which is longer than a predetermined time wherein there is no substantial attenuation of said magnetoresistance of said developer; and decreasing said reference level to a second predetermined level during said interruption time.

7. The method of claim 6 wherein said reference level is increased stepwise.

8. The method of claim 6 wherein said reference level is decreased stepwise.

* * * * *